United States Patent [19]

Soltesz

[11] 4,058,792

[45] Nov. 15, 1977

[54] SHIP SECURITY SYSTEM

[76] Inventor: James A. Soltesz, 15042 Garfield, Allen Park, Mich. 48101

[21] Appl. No.: 671,169

[22] Filed: Mar. 29, 1976

[51] Int. Cl.[2] ..... G08B 21/00

[52] U.S. Cl. ..... 340/29; 340/52 R; 340/282; 116/26; 114/311; 340/63

[58] Field of Search ..... 340/29, 52 F, 52 R, 340/63, 282, 224, 420; 116/26; 114/206, 230

[56] References Cited

U.S. PATENT DOCUMENTS

| | | | |
|---|---|---|---|
| 2,810,120 | 10/1957 | Parker | 340/29 |
| 3,217,291 | 11/1965 | King | 340/29 |
| 3,670,686 | 6/1972 | Reynolds | 114/230 |
| 3,690,285 | 9/1972 | Ellison | 340/29 X |

*Primary Examiner*—Alvin H. Waring
*Attorney, Agent, or Firm*—Robert G. Mentag

[57] ABSTRACT

A security system for a floating structure such as a boat, or the like, and which comprises an electro-mechanical apparatus that is sensitive to substantial changes in the position or orientation of the floating structure. A sensor circuit means is employed for sensing unanticipated changes of conditions of the floating structure. A detector circuit means is operatively connected to said sensor circuit means to detect loss of continuity in said sensor circuit means. An alarm means is operated by the detector circuit means. A power supply means, preferably a 12-volt lead-acid storage battery, is connected to the sensor circuit means, the detector means and the alarm means, to provide operating energy for said sensor and detector circuit means and alarm means.

1 Claim, 4 Drawing Figures

SHIP SECURITY SYSTEM

SUMMARY OF THE INVENTION

This invention relates to security systems, and more particularly to a security system for a floating structure such as a boat, and the like.

The security system of the present invention is adapted to warn the owner of a boat or other floating structure of an unauthorized attempt to move the boat or other floating structure, or of any unanticipated change in climatic conditions severe enough to actuate the security system. When any of the last mentioned actions occur, the security system sounds a suitable alarm, such as a bell, siren, flashing light, or other such alerting device.

The security system of the present invention is an electro-mechanical device which consists of an electronic detector module that is connected to a sensor circuit means for sensing unanticipated changes of condition of a boat or other floating structure. The sensor circuit means includes an electro-mechanical submersible sensor which is adapted to rest on the floor of a sea, and which is operated when a boat or other structure moves substantially, or when the sensor circuit is interrupted, whereby the detector circuit is energized and powers an alarm system. The energy for operating the security system may be supplied by powder on board the boat or other floating structure, such as a 12-volt lead-acid battery, or by a transformer/rectifier system operating on 110-volt A.C. power.

It is an important object of the present invention to provide a security system for a floating structure as a boat or the like which is simple and compact in construction, economical to manufacture and efficient in operation.

It is another object of the present invention to provide a security system for a floating structure such as a boat, or the like, which protects against unanticipated or unauthorized movement of the floating structure, and such movements as are caused by the floating structure being stolen or by severe weather, drifting, losing its mooring tackle, and the like.

It is still another object of the present invention to provide a securing system for a floating structure which comprises a sensor circuit means for sensing unanticipated changes of condition of the floating structure, a detector circuit means connected to said sensor circuit to detect loss of continuity in said sensor circuit, an alarm means operated by said detector circuit means, and a power supply means connected to said sensor circuit means, detector circuit means, and alarm means to provide operating energy for said circuit means and alarm means. The sensor circuit means may include one or more sensor means and it may include a submersible sensor to sense unanticipated changes in position of the floating structure.

It is still a further object of the present invention to provide a submersible sensor for a security system for a floating structure which includes a pair of weights, a switch means including a switch member mounted in each of said pair of weights, and means for movably connecting said weights so that the switch members are connected when the weights are moved into engagement with each other, and the switch members are disconnected when the weights are moved apart.

Other objects, features and advantages of this invention will be apparent from the following detailed description, appended claims, and the accompanying drawings.

DETAILED DESCRIPTION OF THE PREFERRED EMBODIMENT

Figure 1:
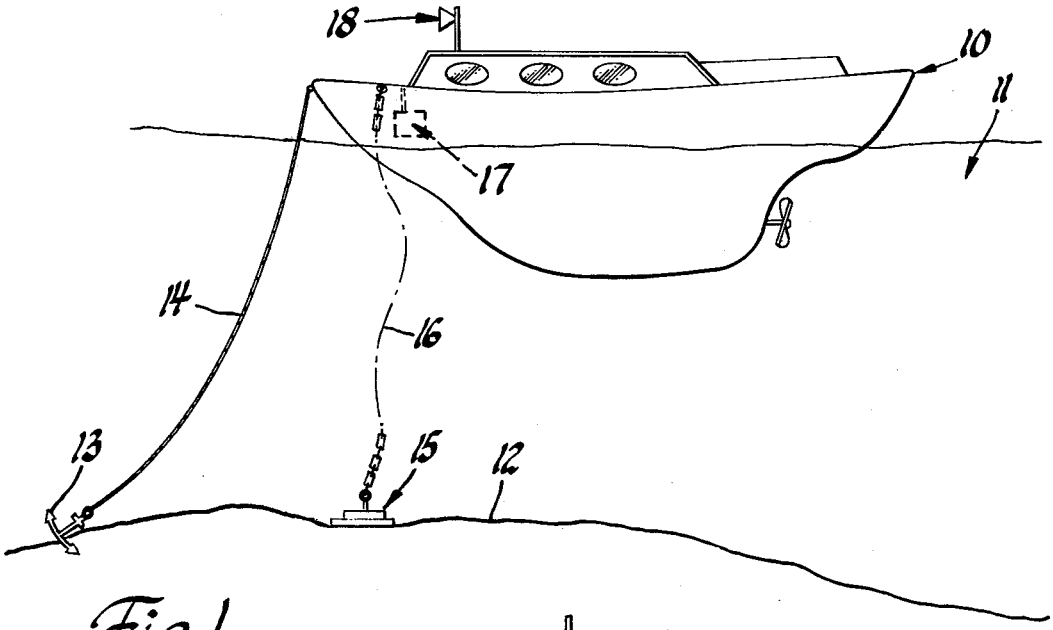
FIG. 1 is a schematic view showing an anchored ship which is provided with a ship security device made in accordance with the principles of the present invention.

Referring now to the drawings, and in particular to FIG. 1, the numeral 10 generally designates an illustrative ship which is provided with a ship security system made in accordance with the principles of the present invention. The numeral 11 generally designates the sea, or other body of water in which the ship 10 is floating, and the numeral 12 designates the floor of the sea. The ship 10 is shown as being anchored by an anchor 13 and an anchor chain 14.

The ship security system of the present invention includes an electro-mechanical sensor, generally indicated in the drawings by the numeral 15. The sensor 15 is lowered to the sea floor 12 by any suitable means, as by a suitable chain 16. The submersible sensor 15 may also be attached to, or integrated with, the anchor 13, or with suitable ground tackle or suitable mooring tackle. The sensor 15 may also be weighted to resist movement by strong currents when resting on the sea floor, or other immovable object.

Figure 4:
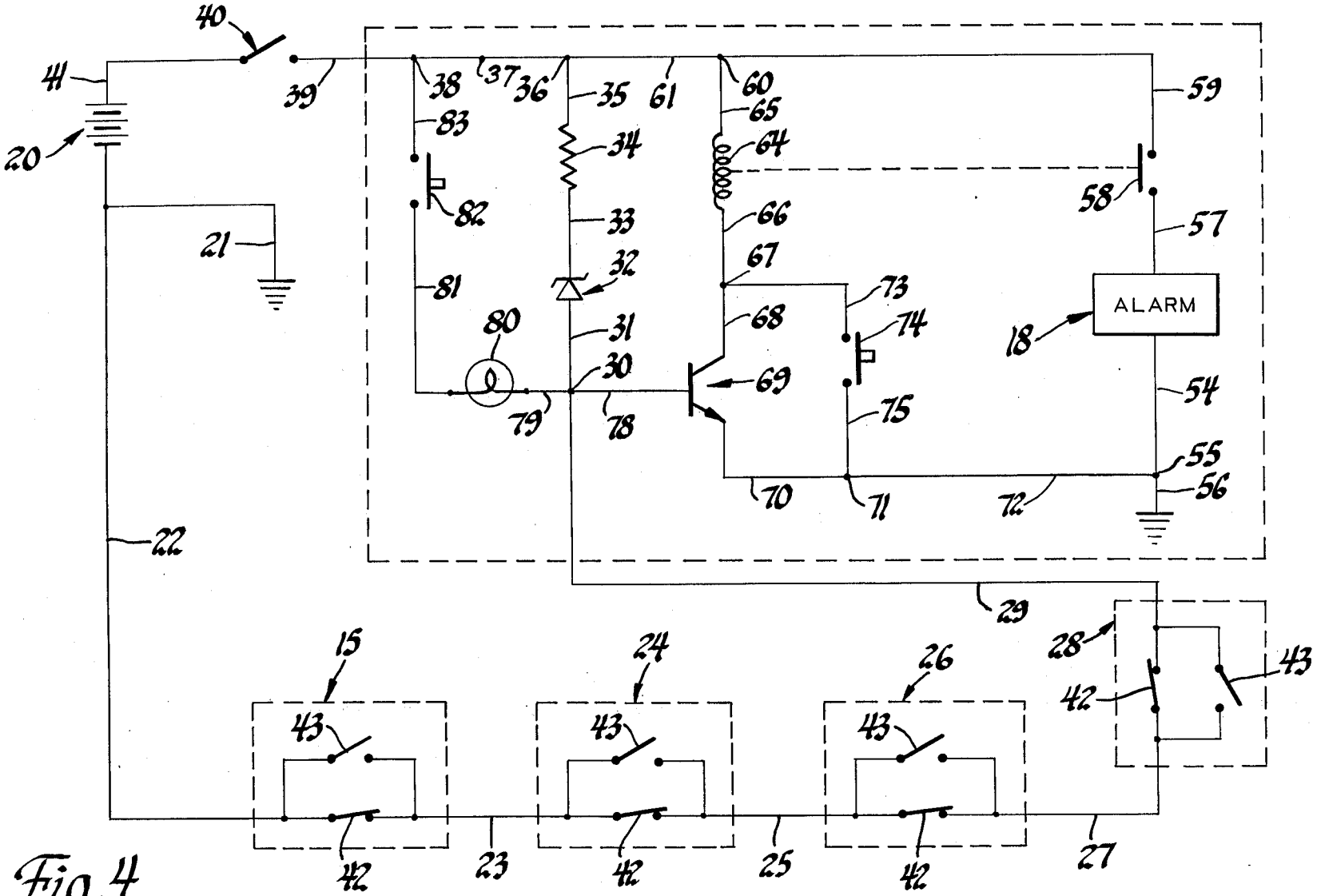
FIG. 4 is a schematic diagram of the ship security system of the present invention.

The ship security system of the present invention also includes a detector unit, generally indicated by the numeral 17 in FIG. 1. The detector unit 17 is operatively mounted inside of the boat or other floating structure. The details of an illustrative detector unit are shown in FIG. 4 and generally indicated by the numeral 17. A suitable alarm or warming means, generally indicated by the numeral 18 in FIG. 1, is also operatively mounted on the boat or other floating structure and is preferably disposed on an exterior surface of the boat or floating structure. The alarm or warning means 18 comprises an electro-mechanical apparatus such as a gong, bell, horn, light, flashlight, siren, or other such alerting devices.

FIG. 4 is a schematic diagram of an illustrative circuit for use in the present invention. However, it will be understood that other circuits may be employed to carry out the desired functions of the present invention. The numeral 20 generally designates a suitable power supply to provide operating energy for the sensors 15, 24 and 26, the detector 17 and the alarm means 18. The power supply 20 may comprise a 12-volt lead-acid storage battery. The energy for the security system of the present invention may also be supplied from a ship's 110 voltage power supply, by employing a transformer/rectifier system.

As shown in FIG. 4, the negative terminal of the battery 20 is grounded, as indicated by the numeral 21. The negative terminal of the battery 20 is also connected to one terminal of the sensor switch 42 of the sensor 15. The switch 42 is illustrated in FIG. 4 as a single pole, single throw electrical switch that is closed in its normal operating condition (a short circuit), but which will switch into open position (open circuit) when moved. The detailed construction of th sensor switch generally indicated by the numeral 42 may vary. One illustrative detailed switch unit that may be employed for the submersible sensor 15 is shown in detail in FIGS. 2 and 3.

Figure 2:
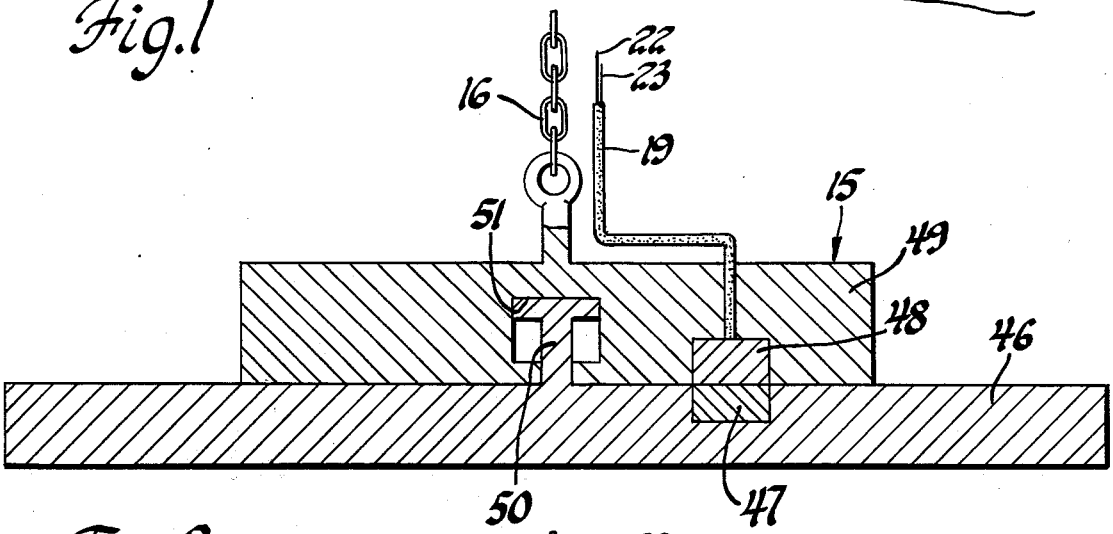
FIG. 2 is an elevational section view of a submersible sensor employed in the invention, and showing the sensor in closed position so as to close the sensor circuit.
Figure 3:
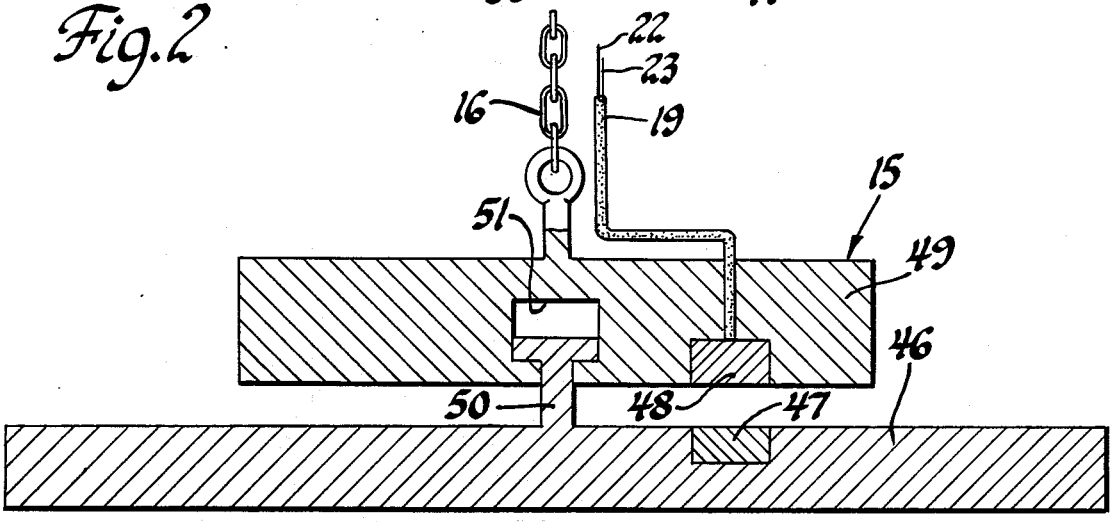
FIG. 3 is an elevational section view of the submersible sensor shown in FIG. 2 and showing the sensor moved to an open position so as to open the sensor circuit.

As shown in FIGS. 2 and 3, the submersible sensor 15 comprises a pair of separable weights 46 and 49. The weight 49 comprises an upper weight and it is operatively connected to the illustrative ship 10 by the chain 16. A lower weight 46 is movably connected to the upper weight 49. The upper weight 49 has a T-shaped slot 51 formed in the lower side thereof in which is mounted a T-shaped connector member 50 that is fixed to the lower weight 46. The head portion of the T-shaped slot 51 has a vertical dimension larger than the dimension of the head of the T-shaped connector 50, so that the weights 46 and 49 may be positioned against each other, as shown in FIG. 1, and be separated from each other, as shown in FIG. 2, for placing the sensor 15 in the sea and then returning it to the ship 10 when the ship is to get under way.

The numerals 47 and 48 comprise a pair of switch members which are illustrative of the type that may be used to provide the function of the switch 42 in the sensor 15 illustrated in FIG. 4. The conductors 22 and 23 of the electrical cable 19 function to interconnect the switch members 47 and 48, to carry out the function of the switch 42 as shown in the sensor 15 in FIG. 4. The illustrated submersible sensor 15 is a solid state electromechanical device that is sensitive to substantial changes in its position or orientation. The switch members 47 and 48 may comprise any suitable type switch, as for example, a micro switch, pressure transducer switch, pressure sensitive electric tape, or other suitable electrical or electronic switch.

The submersible sensor 15 is connected to the electric module detector 17, shown in FIG. 4, and which is carried on the boat 10. When the cable 16 is pulled, the weight 49 is spatially moved to break the connection between the switch members 47 and 48, as shown in FIG. 3.

The last mentioned movement of the sensor 15 opens the sensor circuit, and the detector unit 17 functions as is described more fully herein-after. When the boat 10 or other floating object is anchored, some slack is left in the sensor cable 16 to allow for minor movements of the ship or floating structure without causing the sensor circuit to be opened.

As shown in FIG. 4, the sensor circuit means includes additional sensors, generally indicated by the numerals 24, 26 and 28. The last mentioned sensors may be adapted for any desired use; for example, the sensor 24 may be used to determine whether or not a certain door is open, sensor 26 may be used to determine whether or not a window or porthole is open, and sensor 28 may be used as a high temperature sensor to determine the presence of fire. The sensors 24, 26 and 28 are connected in series with the sensor 15 by the conductors 23, 25 and 27. It will be seen that the sensors 15, 24, 26 and 28 are connected in series to the negative terminal of the power supply 20 and the junction 30 in the detector circuit means 15 by the conductors 22 and 29, respectively. Each of the sensors 24, 26 and 28 is provided with a switch means, generally indicated by the numerals 42, which is normally closed. The sensors 15, 24, 26 and 28 are each provided with a by-pass switch 43 which may be closed to by-pass a particular sensor, or opened to allow each particular sensor to be in operation selectively and independently of the others. For example, a door or porthole may be detected for air without use of the submersible sensor 15. It will be seen that the last described sensor circuit has only two possible conditions; i.e., either a short circuit between the negative pole of the power supply 20 and the junction 30, or an open circuit between the two last mentioned points. The detector circuit means 17 sensors the change from a short circuit to an open circuit.

It will be seen that any type of sensor may be employed that operates as a single pole, single-throw normally closed switch, and which converts to an open circuit upon the occurrence of the unanticipated situation that is being sensed. Any number of sensors can be used, so long as the resistance of each unit contributed to the series circuit when in a normally closed mode is very low, as for example, less than 1 ohm.

It will be understood that the single pole, single-throw normally closed switch 42 used in the circuit of FIG. 4 merely represents the overall behavior of each sensor, but that it may or may not accurately depict the actual internal operation of the particular sensor employed.

The junction 30 comprises part of the detector unit circuit means 17, and it is connected to the positive side of the power supply 20. As shown in FIG. 4, the junction 30 is connected to the positive side of the power supply 20 by conductors 31, 33, 35, 37, 39 and 41, the Zener diode 32, resistor 34, junctions 36 and 38, and the on-off switch 40. The junction 30 is also connected to the base of a transistor, generally indicated by the numeral 69. The emitter of the transistor 69 is connected by the conductors 70, 72, and 54, and the junctions 71 and 55, to one side of the alarm 18. Junction 55 is connected to ground by the conductor 56. The other side of the alarm is connected by conductors 57, 59 and 61, junction 60, and relay conduct switch means 58 to the junction 36, which in turn is connected, as described hereinbefore, to the positive side of the power supply 20. The collector of the transistor 69 is connected to the junction 67, and through the conductor 66 to one side of the relay coil 64 which operates the relay switch 58. The other side of the relay coil 64 is connected by the conductor 65 to the junction 60 which is connected to the positive side of the power supply 20. A test circuit comprises the light 80 which is connected by the conductor 79 to the junction 30, and by the conductor 81 to one side of a normally open push button switch 82. The other side of the push button switch 82 is connected by the conduit 83 to the junction 38, and thence to the positive side of the power supply 20. The push button 82 is closed to test the sensor circuit to show that is is continuous. A second normally open push button switch 74 is used to test the operation of the relay switch means 58 and the alarm 18, without having to disrupt the sensor circuit. The normally open push button switch 74 is connected in parallel with the transistor 69 by having one side connected to the junction 67 through the conductor 73, and the other side thereof connected to the junction 71 by the conductor 75.

FIG. 4 shows an "On-Off" switch 40 in an "Off" position. However, the push button switches 74 and 82, the relay switch means 58, and the other switches in the sensores 15, 24, 26 and 28, are all shown in the normal operating condition; i.e., in a non-alarm condition. The detector unit 17 is designed to monitor the continuity of the sensor circuit. When the "On-Off" switch 40 is moved to the "On" position, the security device is operative, and a circuit is continuous from the junction 30 (base of transistor 69) to the negative terminal of the power supply 20, and the transistor 69 is effectively shorted to ground. Accordingly, the transistor 69 is in an "Off" condition an no current flows through the relay coil 64 so that the contacts of the relay switch means 58 are open, and the alarm 18 is off. The only current flow is a trivial amount, as for example, 0.01 amperes through resistor 34 and the Zener diode 32 to ground through the sensor circuit between the negative terminal of the power supply 20 and the junction 30. When an open circuit occurs between the junction 30 (base of the transistor 69) and the negative terminal of the power supply 20, the alarm 18 is activated. The transistor 69 is turned on by the base drive flowing through the resistor 34 and the Zener diode 32. The current flows through the relay coil 64 so as to close the relay contacts of the relay switch means 58 and to activate the alarm 18.

It will be seen that the detector unit 17 employs a ground return circuit that is separate from the sensor circuit between the base of the transistor 69 and the negative terminal of the power supply 20. The Zener voltage of the diode 32 is chosen by considering the initial terminal voltage of the power supply 20 and the turn-off voltage requirements to protect the power supply 20. The Zener voltage would be generally chosen to be about two volts below the terminal voltage of the fully charged power supply battery. As the battery voltage drops towards Zener voltage, the Zener diode 32 will restrict and finally shut off the base drive of the transistor 69 so as to open the contacts of the relay switch means 58. The use of the Zener diode 32 illustrates one method of a "Self Turn-off" for the alarm system such that the power supply 20 is not fully depleted. When the alarm 18 is activated, it will stay on until the open circuit between the base of the transistor 69 and the negative terminal of the power supply 20 is removed. If the last mentioned open circuit is not removed, the alarm will stay on until the energy that it draws drops the battery voltage of the power supply 20 below the voltage necessary to hold the contacts of the relay switch means 58 in a closed position. The alarm will also stay on if the open circuit is not removed until the battery voltage of the power supply 20 approximately equals the voltage drop across the Zener diode 32, at which time the Zener diode 32 shuts off the transistor base drive. The Zener diode 32 also functions to protect the battery of the power supply 20 from being too severely discharged.

The power supply 20 is preferably a small independent lead-acid battery because such a battery is easily obtainable, inexpensive and easily rechargeable. The boat's battery, or other on-board power used for engine starting and other purposes is also suitable because it is not in danger of being dangerously discharged, and it is independent of 110-volt A.C. power sources. A small battery can also be easily matched to the power requirement of the detector circuit 17; that is, an automatic shut-off of the alarm 18 through drop-out of the relay switch means 58 when shut-off by the Zener diode 32 can be accurately timed, if the battery voltage degrades at a known rate.

It will be understood that circuit components other than those shown, may be used in circuits carrying out the principles of the present invention. For example, a silicone controlled rectifier may be employed as a detector/switch/power amplifier in place of the transistor 69. A latching relay may also be used in place of the relay switch means 58. A time-delay relay may also be used in place of the relay switch means 58. Also, a rectifier 110-volt A.C. may be employed as an alternative to an independent battery power supply.

It will be understood that the detector portion of the circuit illustrated in FIG. 4 could be redesigned to function with the sensors 15, 20, 24, 26 and 28 operating in an open to closed circuit manner, or with combinations of open to closed, and closed to open sensors.

It will be seen that the security system of the present invention may be used on floating structures as a boat, to indicate that the boat is being stolen, drifting or that it has lost its mooring tackle. The alarm may be given by a suitable alerting device, such as a bell, siren, or a light. The security system of the present invention may also be used to detect abnormally high temperatures, the presence of smoke, the presence of water in the bilges and if any windows or doors are being broken. The security system may also be used to energize an alarm circuit in a dinghy tied to a larger craft when it is being stolen or slips its mooring.

An advantage of the security system of the present invention, is that it can operate independent of 110-volt A.C. power, although it can be easily altered to run on such power. Another advantage is that it has a low power consumption in the stand-by mode. Any number of sensors can be used, and any type of sensor of a closed circuit to open circuit may be employed. The security device of the present invention can be integrated with ground tackle for use with such equipment. If needed, weights can be added for using a submersible sensor in fast currents and tides. The alarm or alarms employed in this security system can be such that they will automatically shut themselves off, and a wide variety of different alarms may be employed, either singly or in combination. The security system provides complete security protection for a floating structure, and provides against unanticipated or unauthorized movement, such as if a floating structure is being stolen or a movement caused by severe weather. The security system works equally well if the boat or floating structure is tied to a dock or independently anchored off-shore. It will be understood that any enclosed area may also be protected by the security system, and that it may be easily installed, depending on the number of areas to be secured. The system has the ability to check the condition of all sensors remotely, and to test the alarm without disrupting the sense or circuit. The security system of the present invention is isolated and enclosed, and thus no stray currents are emitted so as to cause corrosion. The use of low voltage D.C. power removes all electrical shock hazards, and the system does not generate any electrical interference when in the stand-by mode.

While it will be apparent that the preferred embodiment of the invention herein disclosed is well calculated to fulfill the objects above stated, it will be appreciated that the invention is susceptible to modification, variation and change.

What is claimed is:

1. A floating structure security system comprising:

a. a sensor circuit means for sensing unanticipated changes of condition of the floating structure;

b. a detector circuit means connected to said sensor circuit to detect loss of continuity in said sensor circuit;

c. an alarm means operated by said detector circuit means;

d. a power supply means connected to said sensor circuit means, detector circuit means, and alarm means to provide operating erergy for said circuit means and alarm means;

e. said sensor circuit means including a submersible sensor to sense unanticipated changes in position of the floating structure; and, f. said submersible sensor including, 1. a pair of weights;
2. a switch means including a switch member mounted in each of said pair of weights; and,
3. means for movably connecting said weights so that the switch members are connected when the weights are moved into engagement with each other and the switch members are disconnected when the weights are moved apart.

* * * * *